US009901237B2

(12) United States Patent
Spinelli

(10) Patent No.: US 9,901,237 B2
(45) Date of Patent: Feb. 27, 2018

(54) DUAL DUCT TELESCOPIC EXTENSION DEVICE FOR VACUUM CLEANERS

(71) Applicant: Spival S.P.A., Larciano (IT)

(72) Inventor: Paolo Spinelli, Larciano (IT)

(73) Assignee: Spival S.P.A., Larciano (PT) (IT)

( * ) Notice: Subject to any disclaimer, the term of this patent is extended or adjusted under 35 U.S.C. 154(b) by 0 days.

(21) Appl. No.: 15/315,493

(22) PCT Filed: Mar. 5, 2015

(86) PCT No.: PCT/IB2015/051607
§ 371 (c)(1),
(2) Date: Dec. 1, 2016

(87) PCT Pub. No.: WO2015/186007
PCT Pub. Date: Dec. 10, 2015

(65) Prior Publication Data

US 2017/0181594 A1 Jun. 29, 2017

(30) Foreign Application Priority Data

Jun. 3, 2014 (IT) ..... FI14A0137

(51) Int. Cl.
*A47L 11/40* (2006.01)
*A47L 11/34* (2006.01)
*A47L 9/24* (2006.01)

(52) U.S. Cl.
CPC ..... *A47L 11/4088* (2013.01); *A47L 9/244* (2013.01); *A47L 11/34* (2013.01); *A47L 11/4044* (2013.01); *A47L 11/4086* (2013.01)

(58) Field of Classification Search
CPC ..... A47L 11/4088; A47L 9/244; A47L 11/34; A47L 11/4044; A47L 11/4086; A47L 9/325; A47L 9/327; A47L 5/28; F16L 27/12; B25G 1/04; A46B 17/02; A46B 5/0033
See application file for complete search history.

(56) References Cited

U.S. PATENT DOCUMENTS 4,385,413 A * 5/1983 Goldsmith ..... A47L 11/4044 15/321
2005/0204504 A1* 9/2005 Zancan ..... A47L 9/244 15/314

FOREIGN PATENT DOCUMENTS

EP 1559360 A1 * 8/2005 ..... A47L 9/244
WO WO 03101273 A1 * 12/2003 ..... A47L 9/244
WO WO 2004028323 A2 * 4/2004 ..... A47L 9/24

* cited by examiner

*Primary Examiner* — Dung Van Nguyen
(74) *Attorney, Agent, or Firm* — Nancy J. Flint, Esq.; Nancy J. Flint, Attorney At Law, P.A.

(57) ABSTRACT

A telescopic extension device for cleaning systems comprising at least one first external tubular assembly and one second internal tubular assembly slidingly coupled with each other so as to vary its own extension. Each tubular assembly comprises two channels for the passage of the fluid streams produced by a vacuum cleaner also capable of producing steam. In a preferred embodiment, the duct featuring the greater diameter is used to suck the air and the particles of dirt whereas the other duct makes steam flow outward.

20 Claims, 3 Drawing Sheets

DUAL DUCT TELESCOPIC EXTENSION DEVICE FOR VACUUM CLEANERS

TECHNICAL FIELD

The present invention belongs to the sector of the devices used to clean floors, carpets, furniture, walls, upholstery, and the like by suction only and in cooperation with the use of other fluids, for instance steam. Specifically, the invention refers to extendible or telescopic ducts, which feature the advantage of easily reaching both distant zones and close surfaces, featuring a plurality of ducts, of types which vacuum cleaner devices also capable of generating steam to make cleaning operations easier are equipped with.

PRESENT STATE OF THE ART

Modern vacuum cleaners are also often capable of generating steam whereby they are provided with special heads also provided with devices to generates such steam.

This is a reason why the extension devices of such vacuum cleaners are dual-duct ones and present numerous variants; often are a special head and a vacuum cleaner connected to each other by one or several rigid, usually rectilinear, tubular elements of a modular type, which are inserted one into the other to increase the overall length of the suction duct, so as to render cleaning easier. Instead of connecting several elements together, it is alternatively possible to use telescopic extension devices, which are more comfortable to use; however, their application is definitely limited in the case of multiple ducts or channels, i.e. whenever they feature several separate passage sections, as in the case considered here.

Traditionally the pipes, be they fixed or telescopic, are coupled with external channels to make it possible the passage of a second fluid; however, solutions are known, even though not without problems, which allow to have two ducts in one and the same telescopic pipe.

For instance, evident are the losses of load and the risks of dirtying that take place in the solutions disclosed in patent application EP1559360 A1 or in patent application WO2004028323 A2.

Some of these drawbacks are solved by patent applications DE10231703 C1 and WO0130228 A1. The former of the two describes a telescopic extension device comprising a main duct and a secondary duct which can be variously arranged with respect to the main duct, i.e. either inside or outside the latter. The secondary duct, also a telescopic one, is defined by two pipes, made of plastic or steel, which are slidingly coupled together through a special sleeve interposed between them; the same solution is adopted to make the internal pipe and the external pipe defining the main duct slide easily. An elastomeric ring present in the special sleeve caters for the airtightness of the secondary duct.

Note that, should the secondary duct be even partially arranged inside the main duct, not always is the axis of the secondary duct rectilinear, but rather it presents some straight angles, necessary for changes of direction; the latter result in significantly obstructing the air flow and dirtying the inner surfaces.

The problems related to plastic elements sliding on each other are clearly illustrated in FIGS. 13 and 14 of the mentioned patent application wherein the need comes out for a gap in the case of plastic channels. This gap is taken advantage of to prevent the plastic elements from getting stuck, which otherwise might occur, should the axes of the two ducts become misaligned because of the pieces scraping each other or the operating thrust exerted by the user being offset.

Patent application WO0130228 (A1) presents two pairs of pipes which slide with respect to each other, thus defining two independent channels. It is possible to note that in this patent application a space has been left between the opposed surfaces which are mutually sliding and that the sliding of the internal pipe with respect to the external pipe is catered for by a guide integral with a closing ring nut and by rings providing a hermetic seal. However, such structure does not allow a quick adjustment of the length of the telescopic extension device.

The solution proposed in patent application WO03101273, even though it presents two dual-duct tubular elements sliding with respect to each other without the presence of gaps as outlined above, does not mention either how could have it solved the sliding problems occurring when adopting a solution like this.

In order to operate satisfactorily without losing airtightness, the known solutions require rather severe tolerances, not compatible with inexpensive manufacturing cycles based on molding plastic materials. Other solutions are complicate to operate or entail important losses of load.

PURPOSES AND SUMMARY OF THE INVENTION

The extension device according to the present patent application makes it possible to comfortably vary its own length, while solving the manufacturing and operating problems highlighted in the present state of the art; its structure caters for a smooth sliding, without any risks for the elements involved of getting undesirably stuck because of misalignments or a poor workmanship.

Such defects are due not only to the manufacturing processes typically used, but also to the operating conditions. The same defects get worse as the extension granted by the telescopic effect grows, through the use of quick release buttons and by reducing the dimensions of the extension device in the radial direction. Remember that, in a 50 centimeters ca. long plastic pipe, the after-molding shrinkage could be as high as some millimeters.

The structure and the arrangements that will be described later cater for an accurate and quick assembly of all component parts. These advantages are achieved by using a limited number of elements, so as to reduce weight, costs, and assembling times, besides providing a configuration that is compact, little cumbersome, and with a limited number of sealed connections.

The extension device according to the present patent application comprises an external tubular assembly and an internal tubular assembly slidingly coupled with each other so as to define a telescopic member.

Advantageously is at least one duct of the tubular assemblies defined by a metal pipe, whose presence makes it possible a continuous sliding without any risk for the tubular assemblies of getting stuck.

Whereas the use of metal pipes represents a known manufacturing option, in the extension device according to the present patent application, surprisingly, at last one metal pipe is co-molded with the shell made of a plastic material. By co-molding we mean that process which aims at obtaining a finished product consisting of different plastic materials or resins and plastics cast with materials incorporated therein or with metals. Co-molding not only offers the advantages described above, but also simplifies the production of the extension device and guarantees a reliable coupling between plastic parts and metal parts, while reducing the space occupied in the radial direction.

Co-molding makes the manufacturing solution described in the present patent application interesting economically wise, and makes it unnecessary, during the assembling step, to fix a considerably long metal pipe inside a plastic shell in a seat located on the side opposite to the inlet zone of said shell; all of this, the parallelism between the different axes of the channels being guaranteed to prevent the individual elements from getting stuck.

The introduction of metal pipes is particularly convenient in the steam duct, because of its reduced diameter and of the risk of geometrical expansions due to the high operating temperatures.

As illustrated in the documents of the known art, a sleeve can be interposed between two telescopically coupled ducts to prevent leakages and to reduce the risks for the elements of getting stuck. Such interposed element is integral with the end of either duct and is in contact with the surfaces of both ducts; however, it is sufficient that it develops over a limited length only and advantageously can it be produced in two component parts to make assembling easier.

In the extension device according to the present patent application, an innovative sleeve has been developed which not only is capable of guiding the sliding but also, surprisingly, is such as to prevent the tubular assemblies from slipping off from each other.

This takes place thanks to a stop element which crosses two holes drilled in the shell of one tubular assembly and in the sleeve itself respectively, so as to make them integral with each other. Therefore, the slipping off of the other tubular assembly is prevented by its engagement with said sleeve.

Said stop element is operated manually, by pressing a cursor and overcoming the action exerted by countering elastic means; this sliding causes the engagement and the disengagement of the top element with respect to a hollow specifically present in the internal tubular assembly.

Whenever the stop element is engaged in said hollow, the extension devices cannot slide, whereas the extension device can vary its own length whenever the stop element is disengaged from the hollow thanks to the pressure exerted by the operator onto the cursor.

To make what said above possible, said cursor is so shaped as to act onto the stop element only when the latter is set to its engagement position; conversely, whenever the cursor is operated, the stop element goes out of the hollow present in the internal shell and translationally moves outwards, thanks to a space present under the cursor itself.

Whereas the solutions adopted in the extension device here described allow to limit the temperatures of the external shell close to the steam duct, it is however possible to envisage the insertion of an additional protection element which further insulates the zone crossed by the high temperature fluid.

DETAILED DESCRIPTION OF AN EMBODIMENT OF THE INVENTION

Figure 1:
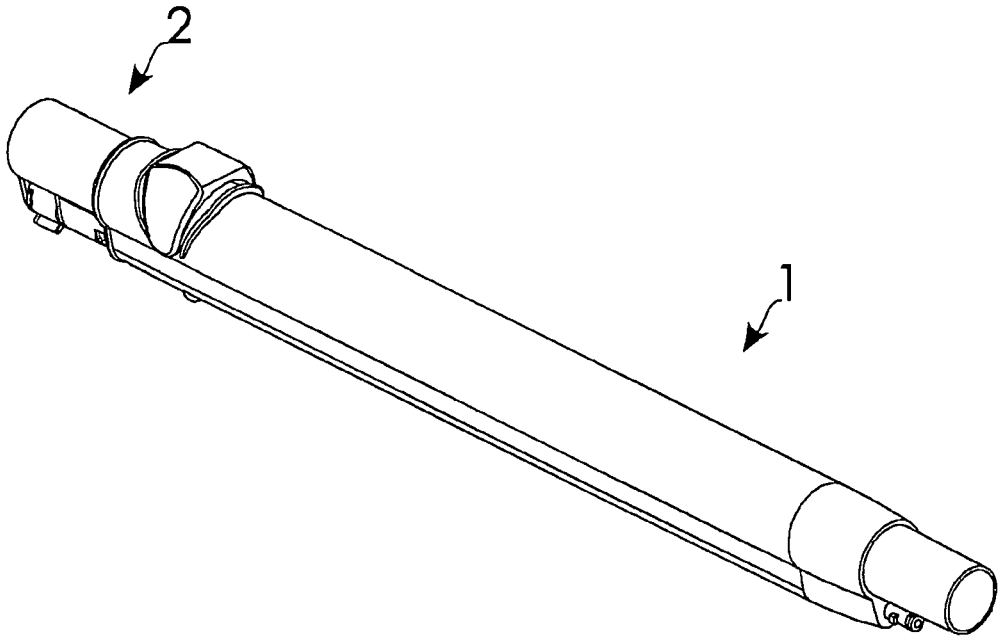
FIG. 1 shows an axonometric view of an embodiment of the extension device according to the present patent application wherein an external tubular assembly (1) and an internal tubular assembly (2) are visible.
Figure 2:
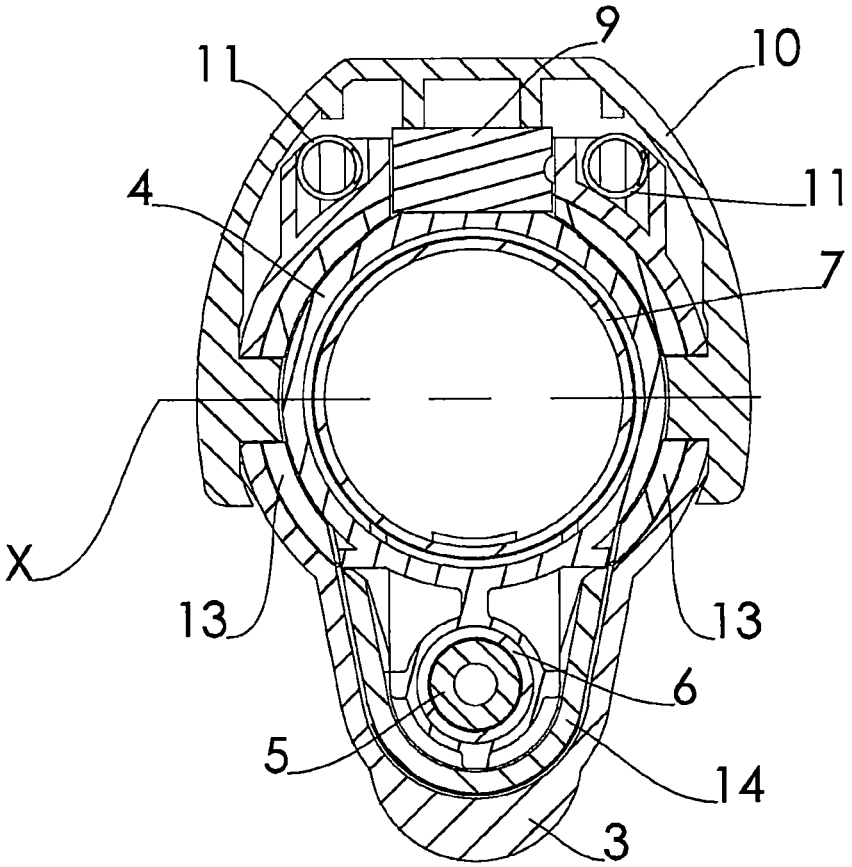
FIG. 2 shows a cross sectional side view of the extension device according to the line of the cross sectional plane shown in FIG. 3. The figure shows an external shell (3) and an internal shell (4) with their respective pipes (5, 6), a pipe made of a metal material (7), a stop element (9), a cursor (10), elastic means (11), a sleeve (13) split into two parts, and an additional protection element (14). The axis X of rotation of the cursor (10) is also shown.

In a preferred embodiment, the extension device according to the present patent application is formed of two tubular assemblies (1, 2), each of which presents two channels for the passage of fluids.

The second tubular assembly (2) is placed inside the first tubular assembly (1) and is slidable with respect to the latter, thus defining a telescopic extension device. The channels for the passage of fluids extend from the mouth piece to the outlet of said extension device and feature axes that are parallel to each other and, in this case, rectilinear.

The first tubular assembly (1) comprises an external shell (3) inside which an air duct and a steam duct are arranged, both made up of, preferably metal, sections of pipes (5, 7).

The second tubular assembly (2) comprises an internal shell (4), defining an air duct and a steam duct, the later made up of a preferably metal section of pipe, co-molded with said internal shell (4); said internal shell (4) being slidable inside said external shell (3).

The inner surface of the air duct defined by said internal shell (4) slides onto the outer surface of the air duct of the external shell (3) made up of said section of pipe (7). Advantageously is the steam duct altogether defined by two, preferably metal, pipes (5, 6), which slide one inside the other. In other words, the inner surface of the metal pipe (6) of the internal tubular assembly (2) slides onto the outer surface of the metal pipe (5) of the external tubular assembly (1).

In order to make the production and the assembling of the piece easier, besides guaranteeing a correct positioning of the component parts, the metal pipes are inserted inside the mold of the shell, made of a plastic material, and are co-molded therewith.

Using metal pipes makes it possible to limit the diameter and the weight of the telescopic extension device and to reduce the risk for the element of getting stuck while sliding one with respect to the other.

The plastic shell presents a typically metal duct inside, featuring thin walls whose geometric tolerances can be better than those of the shell. Also, the presence of a metal material modifies the thermal flow thus further reducing any thermal expansions during the normal operation.

In the embodiment here described, the metal pipes are preferably made of aluminium, whereas the plastic material used for the shells is nylon reinforced with fiberglass, preferably at 20%. However, other materials or plastic materials resistant to the operating temperatures might also be used, provided they offer a sufficient mechanical strength. Let's remember that steam normally reaches temperatures in the range from 110° C. to 120° C.

Figure 3:
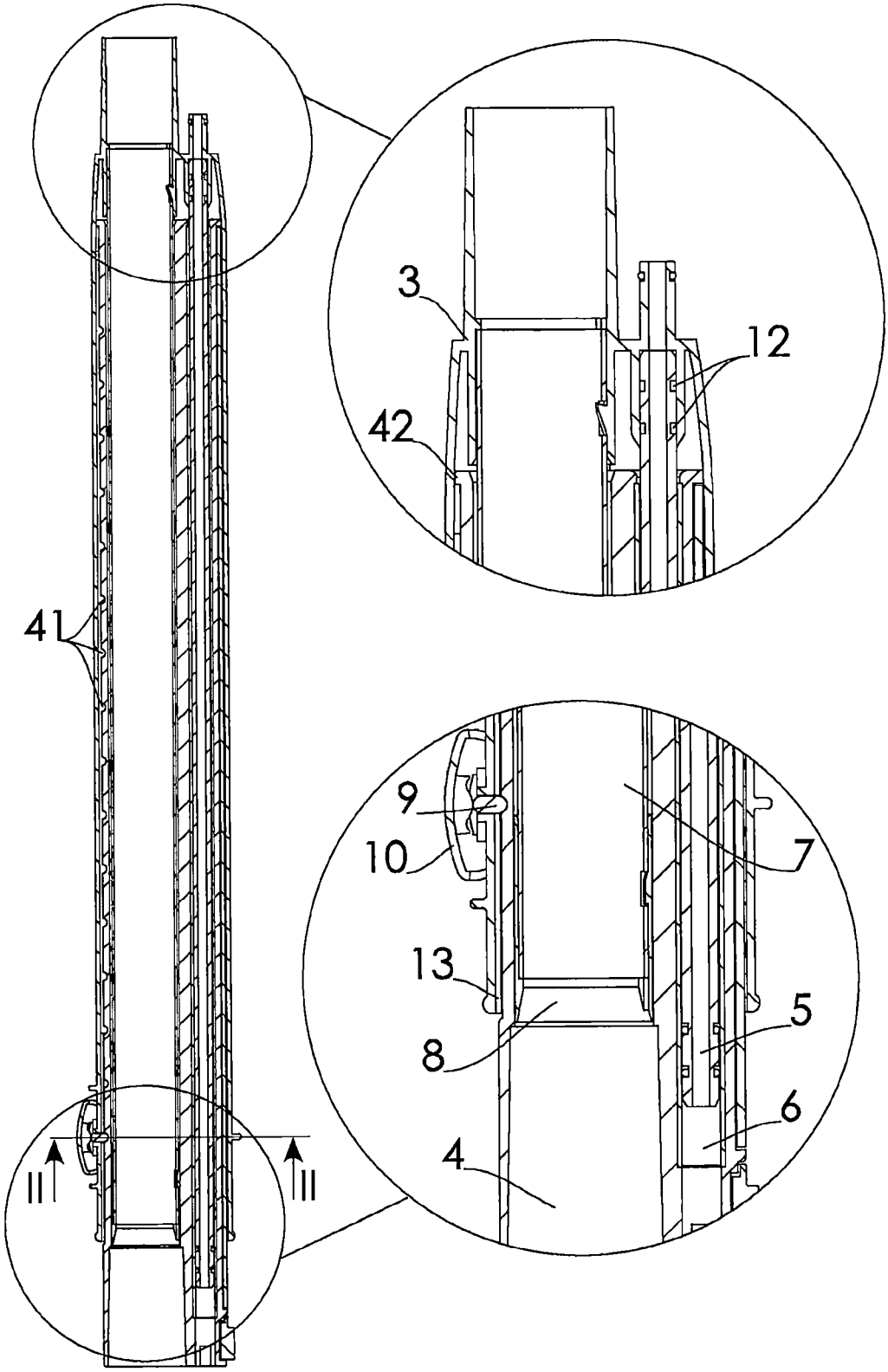
FIG. 3 shows two details of a cross sectional view of another, particularly complete embodiment of the extension device according to the present patent application. The figure shows an external shell (3) and an internal shell (4) with their respective pipes (5, 6), a pipe made of a metal material (7), a bushing (8), a stop element (9), a cursor (10), the seats of gaskets (12), and a sleeve (13). As to the internal shell (4), a number of hollows (41) and a perimetrical radial projection (42) are highlighted. The figure also shows the line of the cross sectional plane of FIG. 2.
Figure 4:
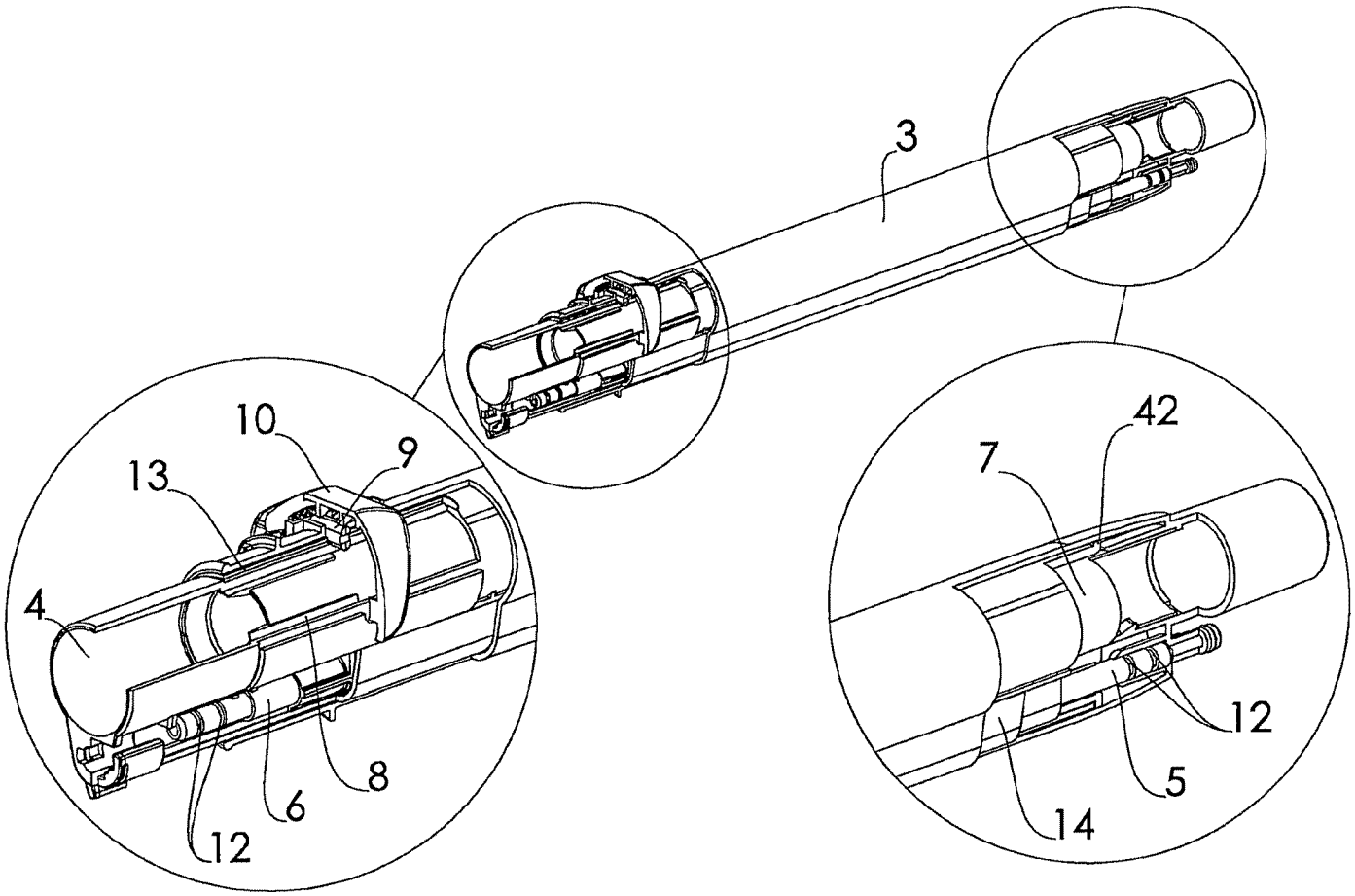
FIG. 4 shows an axonometric cross sectional view of the extension device wherein an external shell (3) and an internal shell (4) with their respective pipes (5, 6), a pipe made of a metal material (7), a bushing (8), a stop element (9), a cursor (10), the seats (12) of gaskets, a sleeve (13), and an additional protection element (14) are visible. A perimetrical radial projection (42) is visible in the detailed view on the right.

Thanks to co-molding the metal pipe (6) of the internal tubular assembly (2) is completely submerged into the shell itself, i.e. it is permanently in contact therewith all over its length; conversely, the metal pipe (5) of the external tubular assembly (1) is only partially co-molded, being it overhanging with respect to a first section of the plastic shell (3) that envelops it, as shown in FIG. 3.

The airtight axial connection between the two metal pipes (5, 6) on the steam side possibly comprises one or several gaskets, each typically formed of at least one elastomeric O-ring, to prevent or reduce any losses or leakages.

Advantageously, in the embodiment here described, the metal pipe (5) of the external shell (3) has two seats for the gaskets (12) at both sides. This feature facilitates the handling of the different component parts from the manufacturing point of view and allows to also insert a pair of gaskets in the mold, which cooperate with the other elements during the molding operation, by fostering the permanent connection between aluminium and the plastic material, besides a correct alignment of the pieces.

According to an alternative embodiment, the gasket seats can be machined in the plastic shell.

The two tubular assemblies slide one with respect to the other and such sliding can be prevented by means of a specifically developed stop element (9), slidable from an internal locking position, wherein said element engages one of the hollows (41) that are aligned in the internal shell (4), to an external released position, wherein said stop element radially slides outwards, thus leaving the hollow where it was formerly engaged. The stop element (9) crosses a hole present on the external shell (3) and thus gets to a point where it engages said hollows (41).

The sliding movement of the stop element (9) is controlled by a rotary cursor (10), embedded in the shell (3) of the external tubular assembly (1), the latter comprising two seats arranged along an axis (X) to receive two respective pins projecting from the lower surface of the cursor.

This way, the cursor (10) is rotationally connected to said external shell (3), around said axis (X), and can assume several positions in the extension direction of the extension device. The lower surface of the cursor (10) features a relief in its middle zone so that, whenever the cursor is set to the central position, said relief presses against the stop element (9) and thus prevents it from disengaging the hollow (41). Conversely, whenever the cursor (10) is displaced from the central position, either onwards or backwards, the stop element (9) is free to move radially over a first section thus enabling the assemblies to slide with respect to each other.

Further, specially developed countering elastic means (11) call said cursor (10) back to its central locking position, so as to cater for a return of the stop element (9) back to its locking position. In the embodiment here described, said elastic means (11) are two helical springs.

The stop element (9) also prevents the internal tubular assembly (2) from totally slipping off from the external tubular assembly (1), by holding in position an intermediate sleeve (13) which, upon reaching the maximum extraction position, counters a perimetrical radial relief (42) present on the end of said internal shell (4) which engages said external shell (3). Said sleeve (13) has a hole which receives said stop element (9) which, after being inserted, makes it integral with said external shell (3).

This solution is extremely simple and easy to implement, and reduces space occupation in the radial direction. The presence of a sleeve (13) is not indispensable, but it is recommended to facilitate a correct sliding between the outer surface of the internal shell (4) and the inner surface of the external shell (3).

Advantageously can the sleeve (13) be split into two parts to make the assembling operation easier and it possibly comprises two seats, in correspondence with those of the external shell (3), to receive the pins of the cursor (10) which further constrain it to the shell.

In an alternative embodiment, the air duct of the external tubular assembly (1) possibly is not made up of a pipe (7), but it is directly defined by the latter.

In a particularly functional embodiment, the pipe (7) is snap-in mounted inside said shell (3) and is made of a metal material, preferably aluminium. In this case too, a good choice of the material reduces the drawbacks, if any, due to the geometrical differences resulting from the actual molding of the pieces.

Advantageously can a bushing (8) interposed between the air ducts of the two tubular assemblies foster the sliding and the alignment between the two tubular assemblies. In a particularly complete embodiment externally to said pipe (7) a bushing (8) is mounted around which said internal shell (4) slides. Said bushing (8), which is preferably made of a plastic material and extends over a short distance, fosters the sliding of the internal shell (4) with respect to the pipe (7) and prevents the fluid flowing in the duct from leaking out.

A particularly complete embodiment comprises an additional U-shaped protection element (14) which isolates the zone where the high temperature fluid passes through and can be embedded.

According to an advantageous constructional option the bushing (8) and the sleeve (13) are made of polypropylene, a material that fosters the sliding of the surfaces in contact with each other, whereas the cursor is made of fiberglass-reinforced nylon. The solutions according to the present patent application make it possible to reduce the manufacturing times and costs and to facilitate the assembling procedures which will be described here below with reference to a particularly complete embodiment of the extension device.

The production of the external tubular assembly (1) begins with positioning the metal pipe (5), provided with two elastomeric rings close to each of its two ends, inside the mold of the external shell (3) and with the subsequent injection of the plastic material.

Having performed the co-molding operation, it is possible to insert the further pipe (7), be it a metal pipe or not, inside the external shell (3), and to snap-in lock it. Preferably before this operation, on the pipe (7) the bushing (8) is keyed.

The internal tubular assembly (2) is produced in a similar way, by inserting a pipe (6) inside the mold.

Having realized the two tubular assemblies, also including the protection element (14), if any, it is possible to couple them, by making them slide one with respect to the other. After covering a first section, it is possible to also assemble the two parts that define the sleeve (13) which will be brought to position by the internal tubular assembly (2).

Finally, the stop element is inserted inside the holes drilled on the external shell (3) and on the sleeve (13), the elastic means (11) are positioned, and the cursor (10) is definitively assembled in the seats located in the external shell (3) as well as the sleeve (13), if any. Having forced the cursor (10) in its operating position, it will cooperate with the stop element (9) to prevent the tubular assemblies from slipping off.

Those skilled in this matter will understand that some of the features present in the particularly complete embodiment described above can otherwise be obtained by means of similar solutions already known in the sector.

It is worth pointing out that, in this patent document, whenever reference is made to metal pipes we mean any products that have dimensional tolerances, structural capabilities, resistance to temperature and to thermal deformations comparable to those of normal metal pipes.

The invention claimed is:

1. An extension device for steam producing vacuum cleaners, comprising an external tubular assembly which slidingly receives an internal tubular assembly, so as to form a telescopic device, each of said tubular assemblies defining two channels for the passage of fluids, one of which is dedicated to the passage of steam, which extend parallel from an input section to an output section of said extension device wherein said external tubular assembly comprises an external shell inside which an air duct and a steam duct are arranged and in that said internal tubular assembly comprises an internal shell, the latter defining an air duct and a steam duct and being sliding inside said external shell; wherein said steam duct of said external tubular assembly is made of a section of metal pipe which is at least partially co-molded together with said external shell, the latter being made of a plastic material.

2. The extension device according to claim 1 wherein said steam duct internal to said internal shell is made of a metal pipe section which is at least partially co-molded with said internal shell.

3. The extension device according to claim 2 wherein both ends of said metal pipe cooperate with at least one gasket in an outer perimetrical seat and wherein at least one of said gaskets is co-molded together with said external shell and said metal pipe.

4. The extension device according to claim 3 wherein the reciprocal sliding between said external tubular assembly and said internal tubular assembly is prevented by the engagement, in one of a plurality of hollows present on said internal shell and aligned along the sliding direction, of a stop element held in position by a movable cursor.

5. The extension device according to claim 4 wherein said air duct of said external tubular assembly is defined by a pipe made of a metal material snap-in mounted inside said external shell.

6. The extension device according to claim 5 wherein a bushing made of a plastic material is externally mounted at the free end of said metal pipe and said internal shell slides thereon.

7. The extension device according to claim 2 wherein the reciprocal sliding between said external tubular assembly and said internal tubular assembly is prevented by the engagement, in one of a plurality of hollows present on said internal shell and aligned along the sliding direction, of a stop element held in position by a movable cursor.

8. The extension device according to claim 1 wherein both ends of said metal pipe cooperate with at least one gasket in an outer perimetrical seat and wherein at least one of said gaskets is co-molded together with said external shell and said metal pipe.

9. The extension device according to claim 1 wherein the reciprocal sliding between said external tubular assembly and said internal tubular assembly is prevented by the engagement, in one of a plurality of hollows present on said internal shell and aligned along the sliding direction, of a stop element held in position by a movable cursor.

10. The extension device according to claim 9 wherein said cursor is rotationally connected to said external shell, so as to move from a central locking position, where its inner surface counters said stop element, thus preventing it from going out of the hollow in which it is engaged, to at least one further sliding position, where said cursor makes it possible for said stop element to disengage itself from said hollow.

11. The extension device according to claim 10 further comprising elastic countering means which counter the displacement of said cursor from its locking position.

12. The extension device according to claim 11 wherein the end of said internal shell which engages said external shell presents a perimetrical radial projection which prevents said internal tubular assembly from being extracted, by engaging a sleeve interposed between said shells and featuring a hole crossed by said stop element which, once inserted, prevents it from going out of said external tubular assembly.

13. The extension device according to claim 12 wherein said sleeve comprises two component parts each of which drilled in such a way as to receive a respective pin projecting from said cursor.

14. The extension device according to claim 13 wherein said air duct of said external tubular assembly is defined by a pipe made of a metal material snap-in mounted inside said external shell.

15. The extension device according to claim 14 wherein a bushing made of a plastic material is externally mounted at the free end of said metal pipe and said internal shell slides thereon.

16. The extension device according to claim 10 wherein the end of said internal shell which engages said external shell presents a perimetrical radial projection which prevents said internal tubular assembly from being extracted, by engaging a sleeve interposed between said shells and featuring a hole crossed by said stop element which, once inserted, prevents it from going out of said external tubular assembly.

17. The extension device according to claim 9 wherein said sleeve comprises two component parts each of which drilled in such a way as to receive a respective pin projecting from said cursor.

18. The extension device according to claim 17 wherein said sleeve comprises two component parts each of which drilled in such a way as to receive a respective pin projecting from said cursor.

19. The extension device according to claim 1 wherein said air duct of said external tubular assembly is defined by a pipe made of a metal material snap-in mounted inside said external shell.

20. The extension device according to claim 19 wherein a bushing made of a plastic material is externally mounted at the free end of said metal pipe and said internal shell slides thereon.

* * * * *